US009908591B1

(12) United States Patent
Ebrahimi

(10) Patent No.: US 9,908,591 B1
(45) Date of Patent: Mar. 6, 2018

(54) HULL ASSEMBLY

(71) Applicant: Shaine Shahin Ebrahimi, Carbondale, CO (US)

(72) Inventor: Shaine Shahin Ebrahimi, Carbondale, CO (US)

( * ) Notice: Subject to any disclaimer, the term of this patent is extended or adjusted under 35 U.S.C. 154(b) by 0 days.

(21) Appl. No.: 15/143,216

(22) Filed: Apr. 29, 2016

Related U.S. Application Data

(60) Provisional application No. 62/154,276, filed on Apr. 29, 2015.

(51) Int. Cl.

| | |
|---|---|
| ***B63B 35/44*** | (2006.01) |
| ***B63B 3/08*** | (2006.01) |
| ***B63B 22/02*** | (2006.01) |
| ***A63B 21/00*** | (2006.01) |
| *B63B 21/20* | (2006.01) |
| *B63B 35/79* | (2006.01) |
| *B63C 1/02* | (2006.01) |

(52) U.S. Cl.
CPC ..... *B63B 22/02* (2013.01); *A63B 21/4027* (2015.10); *B63B 21/20* (2013.01); *B63B 35/79* (2013.01); *B63C 1/02* (2013.01)

(58) Field of Classification Search
CPC .. B63B 22/02; B63C 1/00; B63C 1/02; B63C 1/04
See application file for complete search history.

(56) References Cited

U.S. PATENT DOCUMENTS

| | | | | |
|---|---|---|---|---|
| 3,636,908 | A * | 1/1972 | Feldman | B63B 35/44 114/230.15 |
| 6,006,687 | A * | 12/1999 | Hillman | B63B 3/08 114/45 |
| 7,051,668 | B1 * | 5/2006 | Quinto | B63B 21/00 114/263 |
| 7,426,898 | B1 * | 9/2008 | Ahern | B63C 1/02 114/263 |
| 8,069,807 | B2 * | 12/2011 | Kloster | B63C 3/02 114/259 |
| 8,292,547 | B2 * | 10/2012 | Johanneck | E02B 3/064 114/263 |
| 2016/0023730 | A1 * | 1/2016 | Jeannin | B63B 27/14 114/230.1 |

* cited by examiner

*Primary Examiner* — Andrew Polay
(74) *Attorney, Agent, or Firm* — Plager Schack LLP

(57) ABSTRACT

A hull assembly is configured to connect a plurality of standup paddleboards. The hull assembly includes a forward hull further comprising a forward hull topside having generally semi-ovular shape. A port hull is tethered to the forward hull further comprising a port hull topside which is generally hexagonal. A starboard hull is tethered to the forward hull further comprising a starboard hull topside which is generally hexagonal. An aft hull is tethered to the port hull and the starboard hull and further comprising an aft hull topside having generally semi-ovular shape. Each of the forward hull, the aft hull the port hull and the starboard hull are adapted to accommodate additional standup paddleboards at substantially the same distance from the standup paddleboard.

3 Claims, 5 Drawing Sheets

HULL ASSEMBLY

RELATED APPLICATION

This application claims priority to provisional patent application U.S. Ser. No. 62/145,358 filed on Apr. 29, 2015, the entire contents of which is herein incorporated by reference.

BACKGROUND

The embodiments herein relate generally to vessel hull shape and assembly. Prior to embodiments of the disclosed invention group yoga was difficult to do on a plurality of standup paddleboards, embodiments of the disclosed invention solve that problem.

SUMMARY

A hull assembly is configured to connect a plurality of standup paddleboards. The hull assembly includes a forward hull further comprising a forward hull topside having generally semi-ovular shape. A starboard hull is tethered to the forward hull further comprising a starboard hull topside which is generally hexagonal. A port hull is tethered to the forward hull further comprising a port hull topside which is generally hexagonal. An aft hull is tethered to the starboard hull and the port hull and further comprising an aft hull topside having generally semi-ovular shape. A standup paddle fits between the forward hull, the aft hull the starboard hull and the port hull. Each of the forward hull, the aft hull the starboard hull and the port hull are adapted to accommodate additional standup paddleboards at substantially the same distance from the standup paddleboard.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
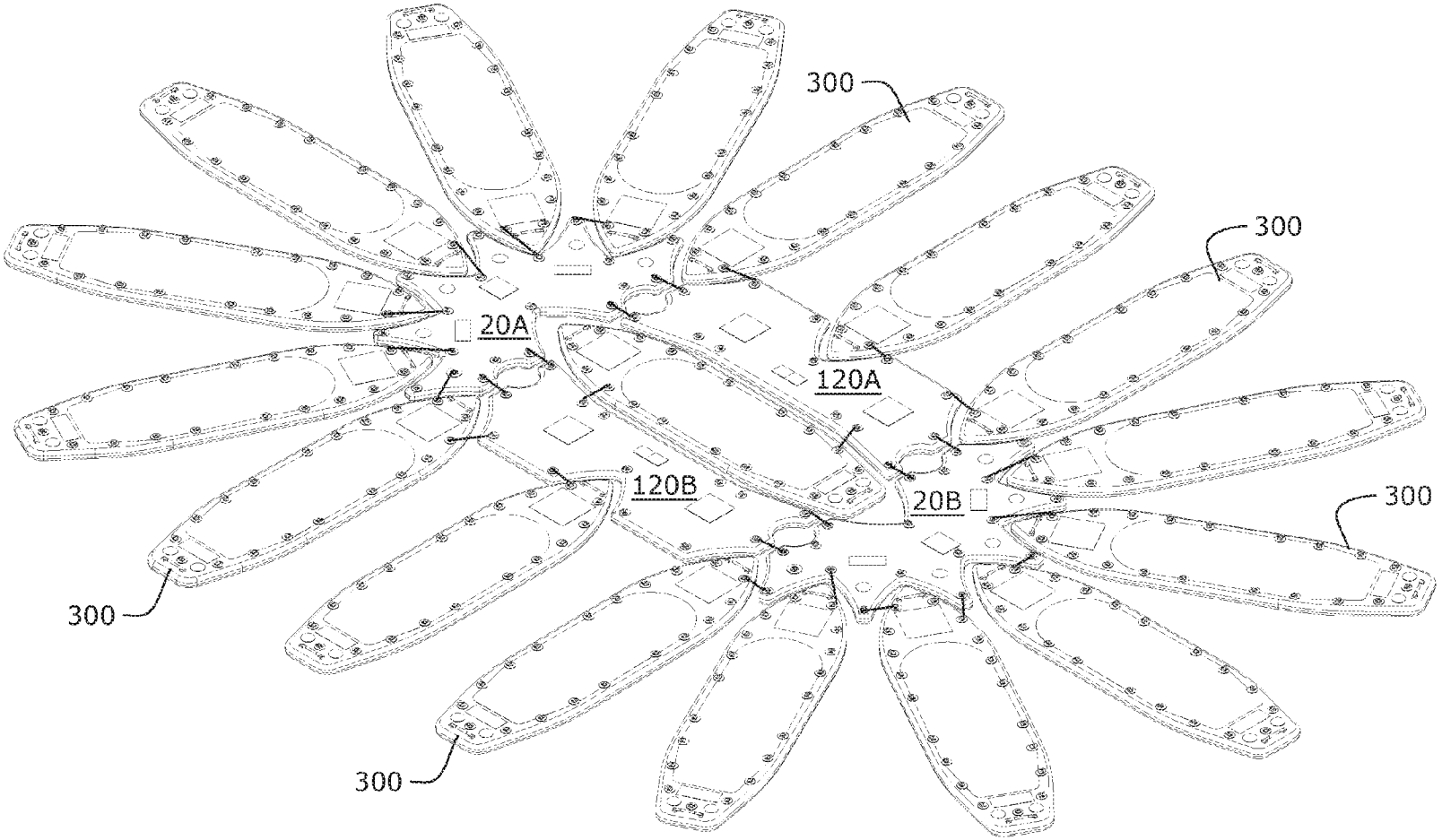
FIG. 1 shows a perspective view of one embodiment of the present invention.
Figure 2:
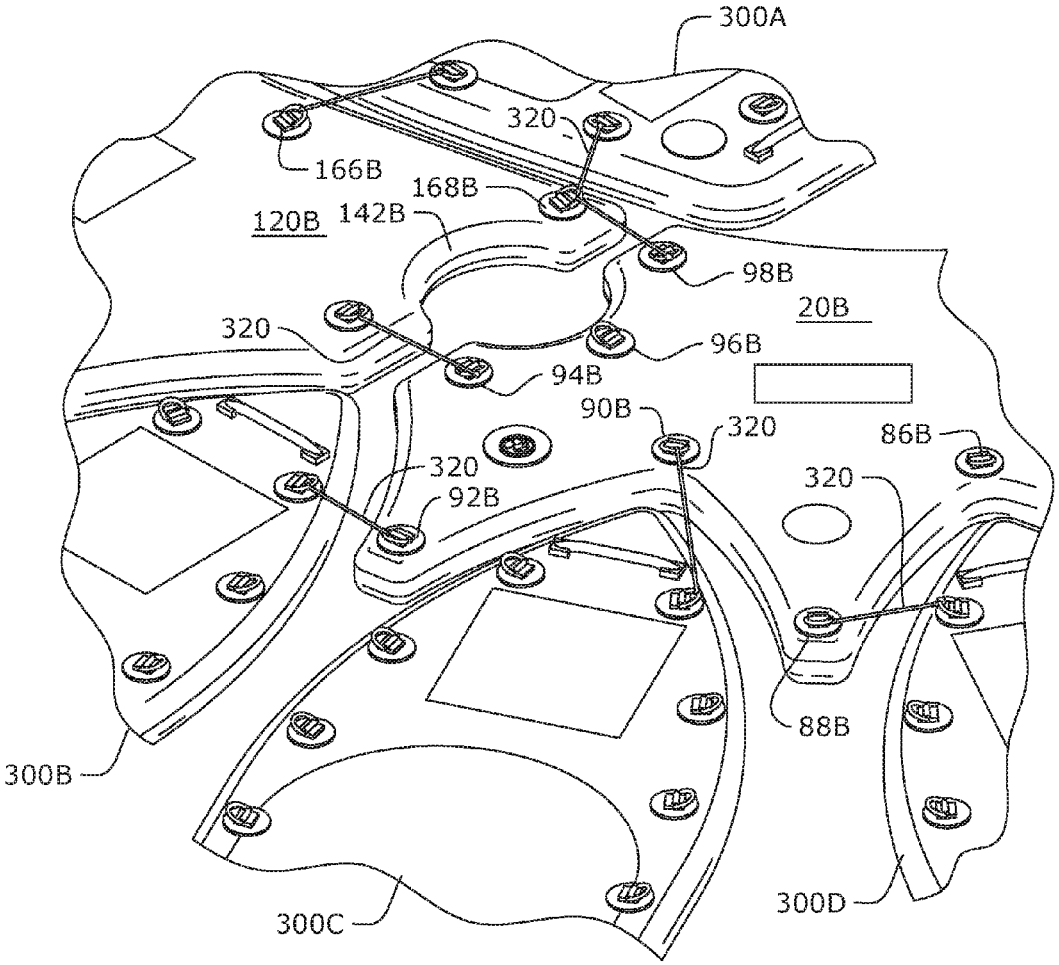
FIG. 2 shows a partial assembly view of one embodiment of the present invention.

By way of example, and referring to FIG. 1, one embodiment of hull assembly 10 comprises forward hull 20A attached to starboard hull 120A and port hull 120B. Starboard hull 120A and port hull 120B are further connected to aft hull 20B. Floating standup paddleboard 30 is located in between these hulls. Additional standup paddleboards 30A, 30B, 30C, and 30D are arranged an approximately equal distance from floating standup paddleboard 30.

Figure 3:
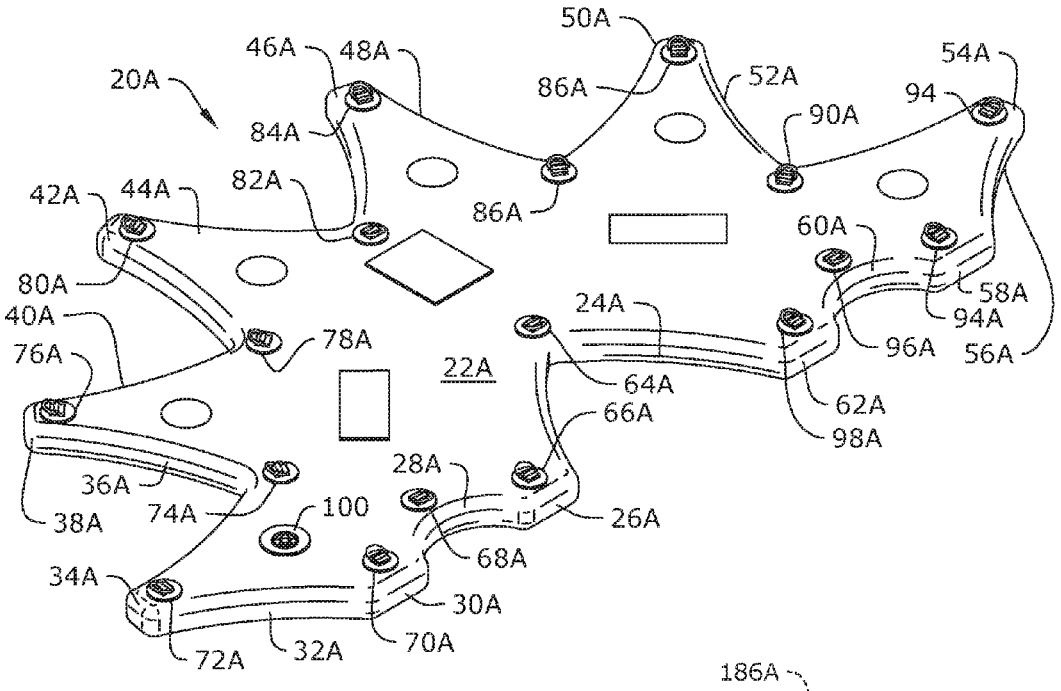
FIG. 3 shows a perspective view of a portion of one embodiment of the present invention.

As shown in FIG. 3, forward hull 20A further comprises forward hull topside 22A. Forward hull topside 22A has a generally semi-ovular shape modified with forward hull first hull insert 24A. Forward hull first hull insert 24A is smoothly connected to forward hull first flat portion 26A. Forward hull first flat portion 26A is smoothly connected to forward hull first slight insert 28A. Forward hull first slight insert 28A is smoothly connected to forward hull second flat portion 30A. Forward hull second flat portion 30A is smoothly connected to forward hull first outward portion 32A. Forward hull first outward portion 32A is smoothly connected to forward hull third flat portion 34A.

Forward hull third flat portion 34A is smoothly connected to forward hull second hull insert 36A. Forward hull second hull insert 36A is smoothly connected to forward hull fourth flat portion 38A. Forward hull fourth flat portion 38A is smoothly connected to forward hull third hull insert 40A. Forward hull third hull insert 40A is smoothly connected to forward hull fifth flat portion 42A. Forward hull fifth flat portion 42A is smoothly connected to forward hull fourth hull insert 44A. Forward hull fourth hull insert 44A is smoothly connected to forward hull fifth flat portion 46A. Forward hull fifth flat portion 46A is smoothly connected to forward hull fifth hull insert 48A. Forward hull fifth hull insert 48A is smoothly connected to forward hull sixth flat portion 50A. Forward hull sixth flat portion 50A is smoothly connected to forward hull sixth hull insert 52A. Forward hull sixth hull insert 52A is smoothly connected to forward hull seventh flat portion 54A. Forward hull seventh flat portion 54A is smoothly connected to forward hull second outward portion 56A. Forward hull second outward portion 56A is smoothly connected to forward hull eighth flat portion 58A. Forward hull eighth flat portion 58A is smoothly connected to forward hull second slight insert 60A. Forward hull second slight insert 60A is smoothly connected to forward hull ninth flat portion 62A.

Forward hull 20A is attached to forward hull first hull insert d-ring 64A proximate forward hull first hull insert 24A. Forward hull first flat portion d-ring 66A is attached proximate forward hull first flat portion 26A. Forward hull first slight insert d-ring 68A is attached proximate forward hull first slight insert 28A. Forward hull second flat portion d-ring 70A is attached proximate forward hull second flat portion 30A. Forward hull first outward portion d-ring 100A is attached proximate forward hull first outward portion 32A. Forward hull third flat portion d-ring 72A is attached proximate forward hull third flat portion 34A. Forward hull second hull insert d-ring 74A is attached proximate forward hull second hull insert 36A. Forward hull fourth flat portion d-ring 76A is attached proximate forward hull fourth flat portion 38A. Forward hull third hull insert d-ring 78A is attached proximate forward hull third hull insert 40A. Forward hull fifth flat portion d-ring 80A is attached proximate forward hull fifth flat portion 42A. Forward hull fourth hull insert d-ring 82A is attached proximate forward hull fourth hull insert 44A. Forward hull fifth flat portion d-ring 84A is attached proximate forward hull fifth flat portion 46A. Forward hull fifth hull insert d-ring 86A is attached proximate forward hull fifth hull insert 48A. Forward hull sixth flat portion d-ring 88A is attached proximate forward hull sixth flat portion 50A. Forward hull sixth hull insert d-ring 90A is attached proximate forward hull sixth hull insert 52A. Forward hull seventh flat portion d-ring 92A is attached proximate forward hull seventh flat portion 54A. Forward hull eighth flat portion d-ring 94A is attached proximate forward hull eighth flat portion 58A. Forward hull second slight insert d-ring 96A is attached proximate forward hull second slight insert 60A. Forward hull ninth flat portion d-ring 98A is attached proximate forward hull ninth flat portion 62A.

Figure 4:
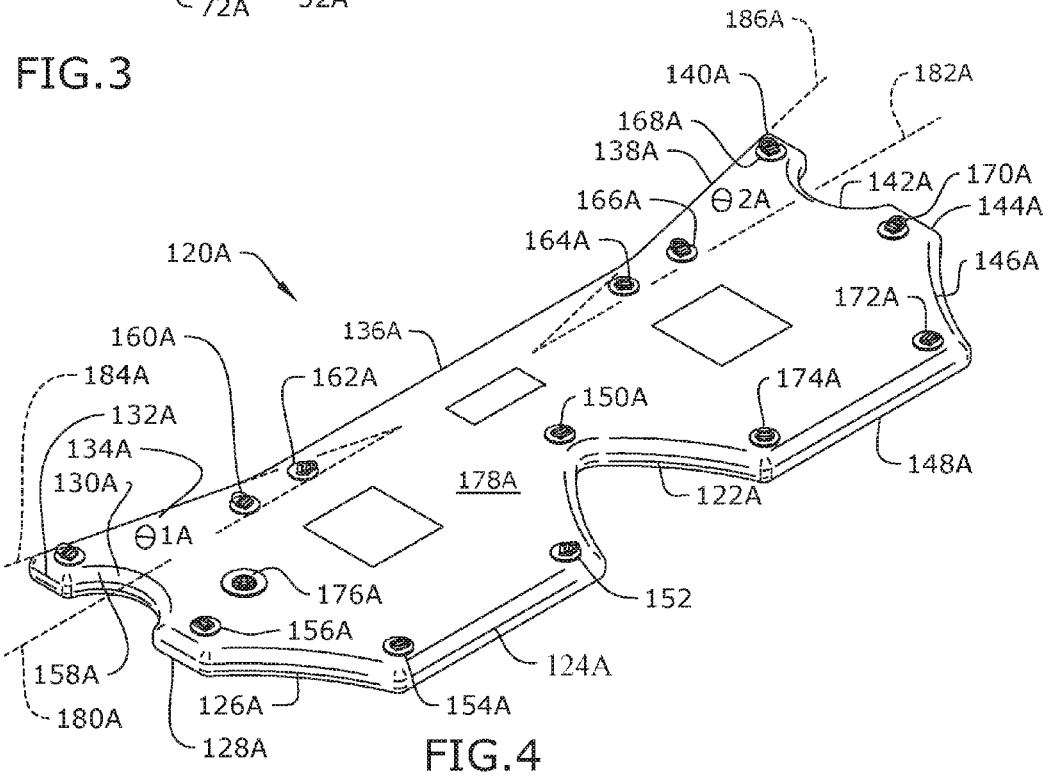
FIG. 4 shows a perspective view of a portion of one embodiment of the present invention.
Figure 5:
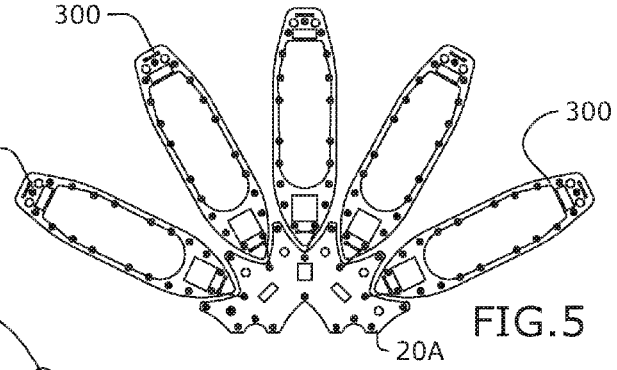
FIG. 5 shows a top view of one embodiment of the present invention.
Figure 6:
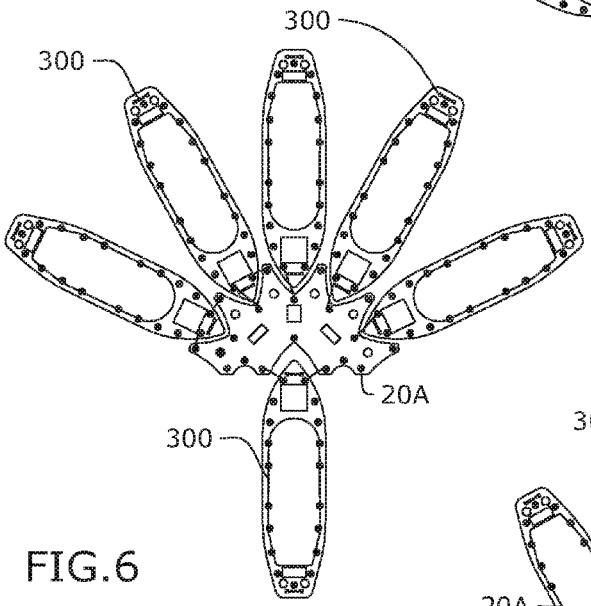
FIG. 6 shows a top view of one embodiment of the present invention.
Figure 7:
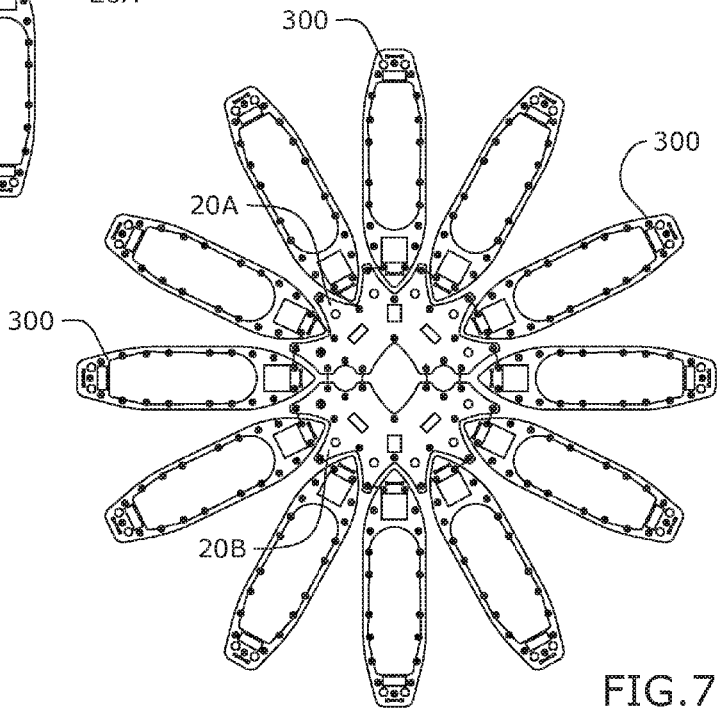
FIG. 7 shows a top view of one embodiment of the present invention.

Turning to FIG. 4, starboard hull 120A further comprises starboard hull topside 178A which is generally hexagonal and modified as follows. Starboard hull first hull insert 122A is smoothly connected to starboard hull first flat portion 124A. Starboard hull first flat portion 124A is smoothly connected to starboard hull first outward portion 126A. Starboard hull first outward portion 126A is smoothly connected to starboard hull second flat portion 128A. Starboard hull second flat portion 128A is smoothly connected to starboard hull first concave portion 130A. Starboard hull first concave portion 130A is smoothly connected to starboard hull third flat portion 132A. Starboard hull third flat portion 132A is smoothly connected to starboard hull first angled portion 134A. Starboard hull first angled portion 134A is smoothly connected to starboard hull fourth flat portion 136A. Starboard hull fourth flat portion 136A is smoothly connected to starboard hull second angled portion 138A. Starboard hull second angled portion 138A is smoothly connected to starboard hull fifth flat portion 140A. Starboard hull fifth flat portion 140A is smoothly connected to starboard hull second concave portion 142A. Starboard hull second concave portion 142A is smoothly connected to starboard hull sixth flat portion 144A. Starboard hull sixth flat portion 144A is smoothly connected to starboard hull second outward portion 146A. Starboard hull second outward portion 146A is smoothly connected to starboard hull seventh flat portion 148A. Starboard hull seventh flat portion 148A is smoothly connected to starboard hull first hull insert 122A.

Starboard hull first hull insert d-ring 150A is attached to starboard hull topside 178A proximate starboard hull first hull insert 122A. Starboard hull first flat portion d-ring 152A is attached to starboard hull topside 178A proximate starboard hull first flat portion 124A. Starboard hull first outward portion d-ring 154A is attached to starboard hull topside 178A proximate starboard hull first outward portion 126A. Starboard hull second flat portion d-ring 156A is attached to starboard hull topside 178A proximate starboard hull second flat portion 128A. Starboard hull first concave portion d-ring 176A is attached to starboard hull topside 178A proximate starboard hull first concave portion 130A. Starboard hull third flat portion B-ring 158A is attached to starboard hull topside 178A proximate starboard hull third flat portion 132A. Starboard hull first angled portion d-ring 160A is attached to starboard hull topside 178A proximate starboard hull first angled portion 134A. Starboard hull fourth flat portion first d-ring 162A and starboard hull fourth flat portion second d-ring 164A are attached to starboard hull topside 178A proximate starboard hull fourth flat portion 136A. Starboard hull second angled portion d-ring 166A is attached to starboard hull topside 178A proximate starboard hull second angled portion 138A. Starboard hull fifth flat portion d-ring 168A is attached to starboard hull topside 178A proximate starboard hull fifth flat portion 140A. Starboard hull sixth flat portion d-ring 170A is attached to starboard hull topside 178A proximate starboard hull sixth flat portion 144A. Starboard hull second outward portion d-ring 172A is attached to starboard hull topside 178A proximate starboard hull second outward portion 146A. Starboard hull seventh flat portion d-ring 174A is attached to starboard hull topside 178A proximate starboard hull seventh flat portion 148A.

Starboard hull fourth flat portion 136A is parallel to and collinear with starboard hull fourth flat portion axis 182A. Starboard hull first angled portion 134A is parallel to and collinear with starboard hull first angled portion axis 184A. Starboard hull second angled portion 138A is parallel to and collinear with starboard hull second angled portion axis 186A. First port angle θ1A is measured clockwise from starboard hull fourth flat portion axis 182A to starboard hull first angled portion axis 184A. Second port angle θ2A is measured counter clockwise from starboard hull fourth flat portion axis 182A to starboard hull second angled portion axis 186A. Preferably, first port angle θ1A equals second port angle θ2A and both are less than 90 degrees.

Figure 8:
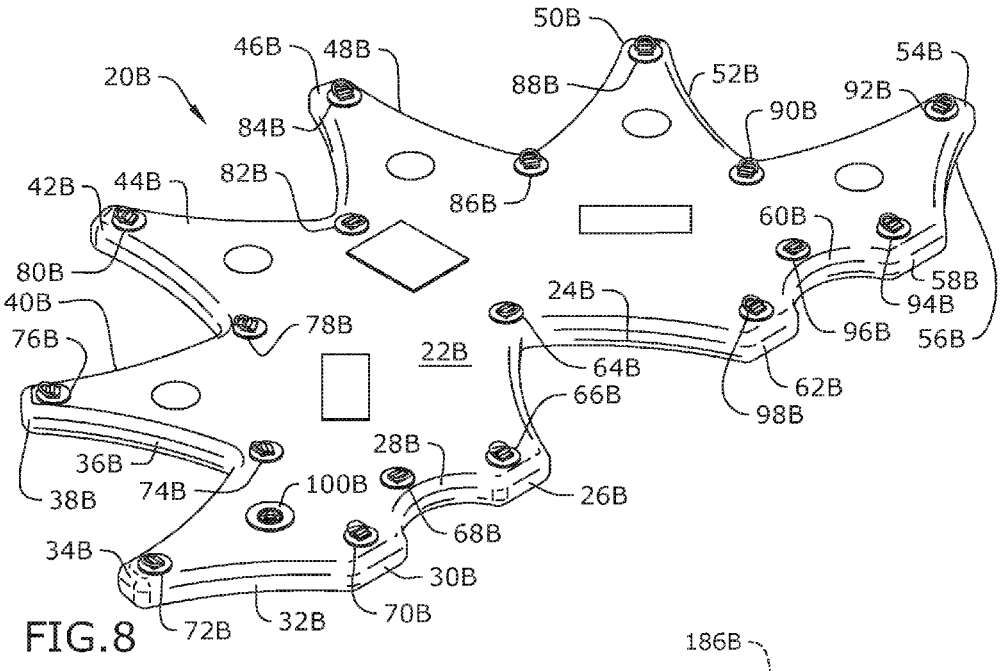
FIG. 8 shows a perspective view of a portion of one embodiment of the present invention.

As shown in FIG. 8, aft hull 20B further comprises aft hull topside 22B. Aft hull topside 22B has a generally semi-ovular shape modified with aft hull first hull insert 24B. Aft hull first hull insert 24B is smoothly connected to aft hull first flat portion 26B. Aft hull first flat portion 26B is smoothly connected to aft hull first slight insert 28B. Aft hull first slight insert 28B is smoothly connected to aft hull second flat portion 30B. Aft hull second flat portion 30B is smoothly connected to aft hull first outward portion 32B. Aft hull first outward portion 32B is smoothly connected to aft hull third flat portion 34B.

Aft hull third flat portion 34B is smoothly connected to aft hull second hull insert 36B. Aft hull second hull insert 36B is smoothly connected to aft hull fourth flat portion 38B. Aft hull fourth flat portion 38B is smoothly connected to aft hull third hull insert 40B. Aft hull third hull insert 40B is smoothly connected to aft hull fifth flat portion 42B. Aft hull fifth flat portion 42B is smoothly connected to aft hull fourth hull insert 44B. Aft hull fourth hull insert 44B is smoothly connected to aft hull fifth flat portion 46B. Aft hull fifth flat portion 46B is smoothly connected to aft hull fifth hull insert 48B. Aft hull fifth hull insert 48B is smoothly connected to aft hull sixth flat portion 50B. Aft hull sixth flat portion 50B is smoothly connected to aft hull sixth hull insert 52B. Aft hull sixth hull insert 52B is smoothly connected to aft hull seventh flat portion 54B. Aft hull seventh flat portion 54B is smoothly connected to aft hull second outward portion 56B. Aft hull second outward portion 56B is smoothly connected to aft hull eighth flat portion 58B. Aft hull eighth flat portion 58B is smoothly connected to aft hull second slight insert 60B. Aft hull second slight insert 60B is smoothly connected to aft hull ninth flat portion 62B.

Aft hull 20B is attached to aft hull first hull insert d-ring 64B proximate aft hull first hull insert 24B. Aft hull first flat portion d-ring 66B is attached proximate aft hull first flat portion 26B. Aft hull first slight insert d-ring 68B is attached proximate aft hull first slight insert 28B. Aft hull second flat portion d-ring 70B is attached proximate aft hull second flat portion 30B. Aft hull first outward portion d-ring 100B is attached proximate aft hull first outward portion 32B. Aft hull third flat portion d-ring 72B is attached proximate aft hull third flat portion 34B. Aft hull second hull insert d-ring 74B is attached proximate aft hull second hull insert 36B. Aft hull fourth flat portion d-ring 76B is attached proximate aft hull fourth flat portion 38B. Aft hull third hull insert d-ring 78B is attached proximate aft hull third hull insert 40B. Aft hull fifth flat portion d-ring 80B is attached proximate aft hull fifth flat portion 42B. Aft hull fourth hull insert d-ring 82B is attached proximate aft hull fourth hull insert 44B. Aft hull fifth flat portion d-ring 84B is attached proximate aft hull fifth flat portion 46B. Aft hull fifth hull insert d-ring 86B is attached proximate aft hull fifth hull insert 48B. Aft hull sixth flat portion d-ring 88B is attached proximate aft hull sixth flat portion 50B. Aft hull sixth hull insert d-ring 90B is attached proximate aft hull sixth hull insert 52B. Aft hull seventh flat portion B-ring 92B is attached proximate aft hull seventh flat portion 54B. Aft hull eighth flat portion B-ring 94B is attached proximate aft hull eighth flat portion 58B. Aft hull second slight insert B-ring 96B is attached proximate aft hull second slight insert 60B. Aft hull ninth flat portion d-ring 98B is attached proximate aft hull ninth flat portion 62B.

Figure 9:
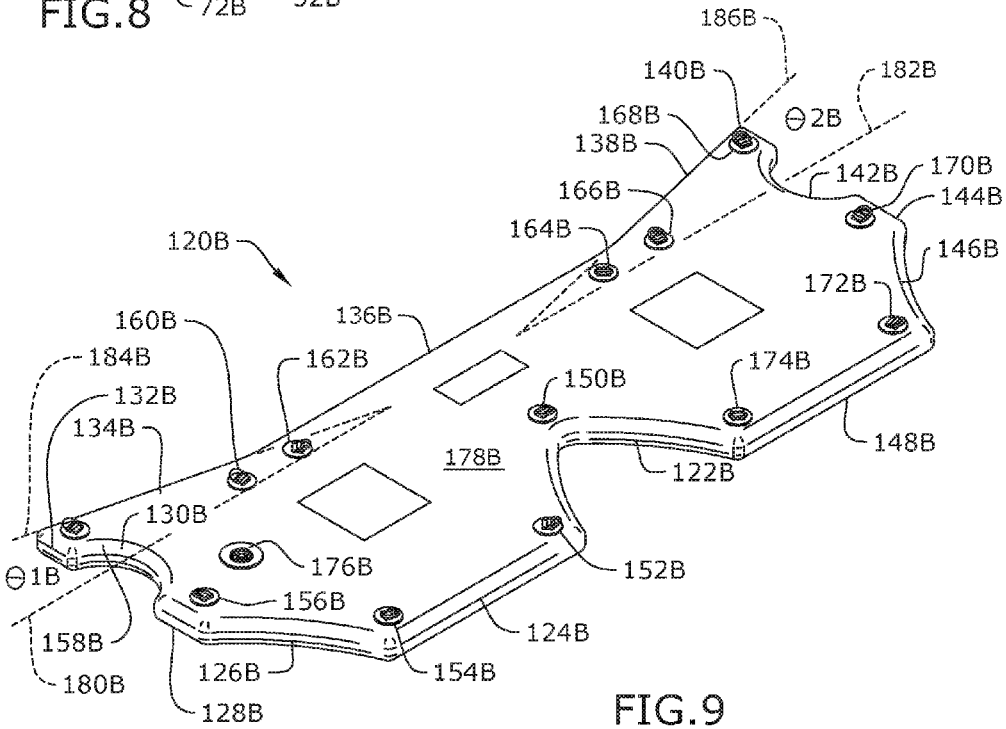
FIG. 9 shows a perspective view of a portion of one embodiment of the present invention.

Turning to FIG. 9, port hull 120B further comprises port hull topside 178B which is generally hexagonal and modified as follows. Port hull first hull insert 122B is smoothly connected to port hull first flat portion 124B. Port hull first flat portion 124B is smoothly connected to port hull first outward portion 126B. Port hull first outward portion 126B is smoothly connected to port hull second flat portion 128B. Port hull second flat portion 128B is smoothly connected to port hull first concave portion 130B. Port hull first concave portion 130B is smoothly connected to port hull third flat portion 132B. Port hull third flat portion 132B is smoothly connected to port hull first angled portion 134B. Port hull first angled portion 134B is smoothly connected to port hull fourth flat portion 136B. Port hull fourth flat portion 136B is smoothly connected to port hull second angled portion 138B. Port hull second angled portion 138B is smoothly connected to port hull fifth flat portion 140B. Port hull fifth flat portion 140B is smoothly connected to port hull second concave portion 142B. Port hull second concave portion 142B is smoothly connected to port hull sixth flat portion 144B. Port hull sixth flat portion 144B is smoothly connected to port hull second outward portion 146B. Port hull second outward portion 146B is smoothly connected to port hull seventh flat portion 148B. Port hull seventh flat portion 148B is smoothly connected to port hull first hull insert 122B.

Port hull first hull insert d-ring 150B is attached to port hull topside 178B proximate port hull first hull insert 122B. Port hull first flat portion d-ring 152B is attached to port hull topside 178B proximate port hull first flat portion 124B. Port hull first outward portion d-ring 154B is attached to port hull topside 178B proximate port hull first outward portion 126B. Port hull second flat portion d-ring 156B is attached to port hull topside 178B proximate port hull second flat portion 128B. Port hull first concave portion d-ring 176B is attached to port hull topside 178B proximate port hull first concave portion 130B. Port hull third flat portion d-ring 158B is attached to port hull topside 178B proximate port hull third flat portion 132B. Port hull first angled portion d-ring 160B is attached to port hull topside 178B proximate port hull first angled portion 134B. Port hull fourth flat portion first d-ring 162B and port hull fourth flat portion second d-ring 164B are attached to port hull topside 178B proximate port hull fourth flat portion 136B. Port hull second angled portion d-ring 166B is attached to port hull topside 178B proximate port hull second angled portion 138B. Port hull fifth flat portion d-ring 168B is attached to port hull topside 178B proximate port hull fifth flat portion 140B. Port hull sixth flat portion d-ring 170B is attached to port hull topside 178B proximate port hull sixth flat portion 144B. Port hull second outward portion d-ring 172B is attached to port hull topside 178B proximate port hull second outward portion 146B. Port hull seventh flat portion d-ring 174B is attached to port hull topside 178B proximate port hull seventh flat portion 148B.

Port hull fourth flat portion 136B is parallel to and collinear with port hull fourth flat portion axis 182A. Port hull first angled portion 134B is parallel to and collinear with port hull first angled portion axis 184B. Port hull second angled portion 138B is parallel to and collinear with port hull second angled portion axis 186B. First starboard angle θ1B is measured clockwise from port hull fourth flat portion axis 182A to port hull first angled portion axis 184B. Second starboard angle θ2B is measured counter clockwise from port hull fourth flat portion axis 182A to port hull second angled portion axis 186B. Preferably, first starboard angle θ1B equals second starboard angle θ2B and both are less than 90 degrees.

As shown in FIG. 2 and FIGS. 5-7, a variety of stand up paddleboards 300A, 300B, 300C, and 300D are tethered to hull assembly 10 with lines 320. Likewise hull assembly 10 is tethered together with lines 320.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A hull assembly, configured to connect a plurality of standup paddleboards, comprising:

a forward hull further comprising a forward hull topside further comprising a semi-circular side with a plurality of triangular shaped cut outs and a partial cutout arranged about a circumferential edge of the semi-circular side; wherein the cut outs are configured to accommodate a portion of a watercraft;

a port hull, tethered to the forward hull further comprising a port hull topside which is approximately a quadrilateral with a pair of truncated corners and a centrally located cutout and a second partial cut out on one side; wherein the centrally located cutout is configured to accommodate a second portion of a second watercraft; wherein the partial cutout and the cutout operate together to accommodate a third portion of a third watercraft;

a starboard hull, tethered to the forward hull further comprising a starboard hull topside; and an aft hull, tethered to the port hull and the starboard hull and further comprising an aft hull topside.

2. The hull assembly of claim 1, wherein the forward hull further comprises:

a forward hull first hull concave portion, smoothly connected to a forward hull first flat portion;

a forward hull first slight concave portion, smoothly connected to the forward hull first flat portion;

a forward hull second flat portion, connected to the forward hull first slight concave portion;

a forward hull first outward portion, connected to the forward hull second flat portion;

a forward hull third flat portion, connected to the forward hull first outward portion;

a forward hull second hull concave portion, smoothly connected to the forward hull third flat portion;

a forward hull fourth flat portion, connected to the forward hull second hull concave portion;

a forward hull third hull concave portion, connected to the forward hull fourth flat portion;

a forward hull fifth flat portion, connected to the forward hull third hull concave portion;

a forward hull fourth hull concave portion, connected to the forward hull fifth flat portion;

a forward hull fifth flat portion, connected to the forward hull fourth hull insert;

a forward hull fifth hull concave portion, connected to the forward hull fifth flat portion;

a forward hull sixth flat portion, connected to the forward hull fifth hull concave portion;

a forward hull sixth hull concave portion, smoothly connected to the forward hull sixth flat portion;

a forward hull seventh flat portion, connected to the forward hull sixth hull concave portion;

a forward hull second outward portion, connected to the forward hull seventh flat portion;

a forward hull eighth flat portion, connected to the forward hull second outward portion;

a forward hull second slight concave portion, connected to the forward hull eighth flat portion; and a forward hull ninth flat portion, connected to the forward hull second slight insert.

3. The hull assembly of claim 1, wherein the port hull further comprises:

a port hull first hull concave portion, connected to a port hull first flat portion;

a port hull first outward portion, connected to the port hull first flat portion;

a port hull second flat portion, connected to the port hull first outward portion;

a port hull second concave portion, connected to the port hull second flat portion;

a port hull third flat portion, connected to the port hull second concave portion;

a port hull first angled portion, connected to the port hull third flat portion;

a port hull fourth flat portion, connected to the port hull first angled portion;

a port hull second angled portion, connected to the port hull fourth flat portion;

a port hull fifth flat portion, connected to the port hull second angled portion;

a port hull second concave portion, connected to the port hull fifth flat portion;

a port hull sixth flat portion, connected to the port hull second concave portion;

a port hull second outward portion, connected to the port hull sixth flat portion; and a port hull seventh flat portion, connected to the port hull second outward portion and the port hull first hull concave portion.

* * * * *